US011321994B2

(12) United States Patent
Prabhaker et al.

(10) Patent No.: US 11,321,994 B2
(45) Date of Patent: May 3, 2022

(54) METHODS, DEVICES AND SYSTEMS FOR ELECTRONICALLY MOVING FUNDS BETWEEN AN E-WALLET AND A GAMING MACHINE

(71) Applicant: Everi Payments Inc., Austin, TX (US)

(72) Inventors: Naveen Chander Prabhaker, Las Vegas, NV (US); Gunaseelan Rajendran, Las Vegas, NV (US)

(73) Assignee: Everi Payments Inc., Las Vegas, NV (US)

( * ) Notice: Subject to any disclaimer, the term of this patent is extended or adjusted under 35 U.S.C. 154(b) by 0 days.

(21) Appl. No.: 17/069,634

(22) Filed: Oct. 13, 2020

(65) Prior Publication Data

US 2021/0110650 A1 Apr. 15, 2021

Related U.S. Application Data

(60) Provisional application No. 62/914,905, filed on Oct. 14, 2019.

(51) Int. Cl.

| | |
|---|---|
| ***G07F 17/34*** | (2006.01) |
| ***G07F 17/32*** | (2006.01) |
| ***G06Q 50/34*** | (2012.01) |

(52) U.S. Cl.

CPC ..... *G07F 17/3244* (2013.01); *G06Q 50/34* (2013.01); *G07F 17/3227* (2013.01)

(58) Field of Classification Search

CPC ..... G07F 17/3244; G07F 17/3227

See application file for complete search history.

(56) References Cited

U.S. PATENT DOCUMENTS

| | | | | |
|---|---|---|---|---|
| 6,379,246 | B1 | 4/2002 | Dabrowski | |
| RE39,401 | E * | 11/2006 | Alcorn | G06F 21/00 463/29 |
| 8,133,102 | B2 | 3/2012 | Dabrowski | |
| 8,414,382 | B2 | 4/2013 | Denham et al. | |
| 8,512,144 | B2 | 8/2013 | Johnson et al. | |
| 8,715,066 | B2 | 5/2014 | Prather et al. | |
| 8,784,213 | B2 | 7/2014 | Johnson | |
| 9,235,952 | B2 | 1/2016 | Nguyen | |
| 9,373,107 | B2 | 6/2016 | Johnson | |
| 9,582,963 | B2 | 2/2017 | Johnson | |
| 9,613,491 | B2 | 4/2017 | Roth | |
| 9,728,043 | B2 | 8/2017 | Acres | |
| 10,002,492 | B2 | 6/2018 | Johnson | |
| 10,325,448 | B2 | 6/2019 | Johnson | |
| 10,497,212 | B2 | 12/2019 | Nguyen | |
| 11,017,629 | B2 | 5/2021 | Johnson | |
| 2009/0131146 | A1 * | 5/2009 | Arezina | G07F 17/32 463/20 |

(Continued)

*Primary Examiner* — Corbett B Coburn

(74) *Attorney, Agent, or Firm* — Weide & Miller, Ltd.

(57) ABSTRACT

An interface, such as a cashless interface, is interposed between a communication port of a gaming machine and one or more external devices and systems, such as a slot machine interface board and a slot management system. The cashless interface may further communicate with a financial system, such as via a controller and a gateway. The cashless interface may be used to facilitate the transfer of funds between a player's e-wallet associated with the financial system and a gaming machine, such as initiated via a player via their mobile communication device.

9 Claims, 4 Drawing Sheets

(56) References Cited

U.S. PATENT DOCUMENTS

| | | | | |
|---|---|---|---|---|
| 2014/0302915 | A1* | 10/2014 | Lyons | G07F 17/3237 463/25 |
| 2014/0323209 | A1* | 10/2014 | Sanford | G06Q 30/0226 463/25 |
| 2015/0228153 | A1* | 8/2015 | Hedrick | G06Q 20/3223 463/25 |
| 2016/0133089 | A1* | 5/2016 | Roemer | G07F 17/3223 463/40 |
| 2019/0073866 | A1* | 3/2019 | Johnson | G07F 17/3251 |
| 2020/0410813 | A1* | 12/2020 | Petersen | G06Q 20/3278 |
| 2021/0110653 | A1* | 4/2021 | Olmstead | G07F 17/3251 |

* cited by examiner

METHODS, DEVICES AND SYSTEMS FOR ELECTRONICALLY MOVING FUNDS BETWEEN AN E-WALLET AND A GAMING MACHINE

RELATED APPLICATION DATA

This application claims priority to, and incorporates by reference as if set forth herein, U.S. Provisional Application Ser. No. 62/914,905, filed Oct. 14, 2019.

FIELD OF THE INVENTION

The present invention relates to gaming machines, and particularly gaming machines that present wager-based games.

BACKGROUND OF THE INVENTION

A wide variety of configurations of gaming machines have been developed. In the case of gaming machine that present wager-based games, such gaming machines must include a mechanism for receiving money or elements representing monetary value from which the player may place wagers. For example, a gaming machine might include a coin acceptor or a bill validator for receiving coins or currency. Gaming machines also frequency accept monetary value tickets, such as by a ticket reader.

Gaming machines that only accept money or tickets limit the ways that a player can fund wagering at the machine. While newer gaming machines might be manufactured to accept funds via other sources, such as using a credit card reader or the like, such solutions to not readily work with existing gaming machines that do not have those features.

SUMMARY OF THE INVENTION

Embodiments of the invention comprise methods, devices and systems for moving funds to and from a gaming machine, such as to and from an electronic wallet ("e-wallet"), including via a mobile communication device.

In one embodiment, a cashless interface is interposed between a communication port, such as a SAS port, of a gaming machine and one or more external devices and systems, such as a slot machine interface board and a gaming machine or "slot" management system. The cashless interface is further configured to communicate with a financial system, such as via a cashless controller and a gateway.

In one embodiment, the cashless interface is used to facilitate a transfer of funds from a player's e-wallet associated with the financial system to the gaming machine, or to facilitate a transfer of funds from the gaming machine to the player's e-wallet. In one embodiment, a funds transfer may be initiated by a player via a mobile communication device, such as a smart phone. Upon initiating a transaction via their smart phone, a gaming machine identifier may be provided to the player's smart phone, which then communicates with the financial system to initiate the funds transfer. The financial system communicates with the cashless interface of the designated gaming machine such as via the cashless controller. The cashless interface communicates with the gaming machine via the communication port to request a transfer of funds to or from the designated gaming machine, such as by incrementing or decrementing one or more meters of the gaming machine.

The cashless interface does not interrupt standard communications between the gaming machine and other systems such as the casino's slot management system, such as via the slot machine interface board.

The cashless interface may be utilized to obtain various information from the gaming machine via the communication port thereof, such as for implementing other functionality including jackpot reporting and processing, player activity tracking and rewards/loyalty functions and the like.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Aspects of the invention comprise methods, devices and systems for moving funds to and from a gaming machine, such as to and from an electronic wallet ("e-wallet") via a mobile communication device.

Figure 1:
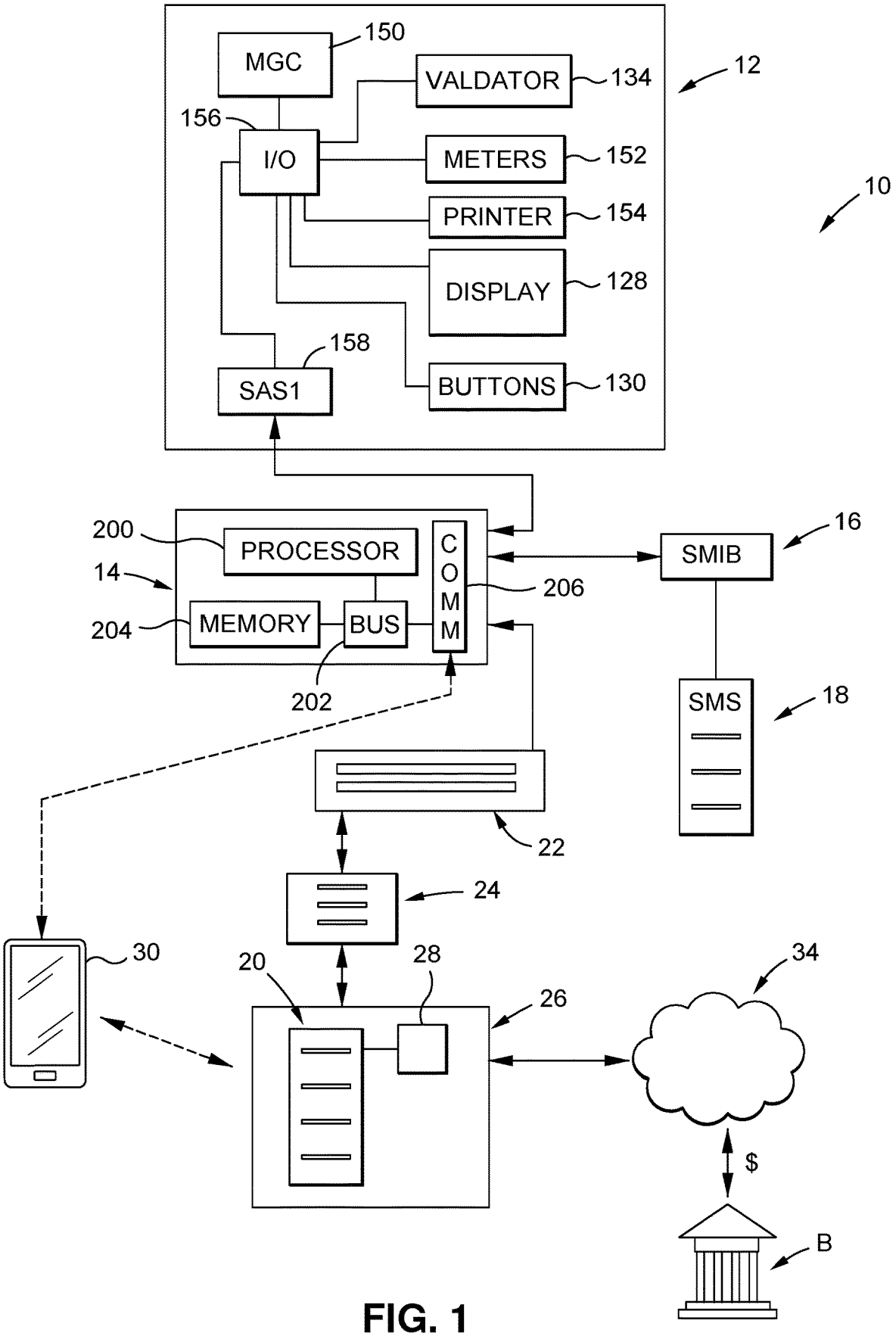
FIG. 1 illustrates an embodiment of the invention comprising a system which includes a gaming machine having an interface in accordance with the invention.

Aspects of the invention will be described first with reference to FIG. 1. FIG. 1 illustrates a system 10 of the present invention. Aspects of the system 10 may be provided by, controlled by or operated by the same entity or one or more different entities.

The system 10 includes at least one electronic gaming machine (gaming machine or EGM) 12, such as a slot machine, video poker machine or the like. Additional aspects of the gaming machine 12 are described below. The gaming machine 12 might be located at a casino or other location where gaming is offered.

The system 10 also includes a cashless interface 14, a slot machine interface board (SMIB) 16, a gaming machine or "slot" management system ("SMS") 18, a cashless controller 22, a gateway 24, and a financial system 26. Aspects of these different components and their operation are provided in more detail below.

Figure 2:
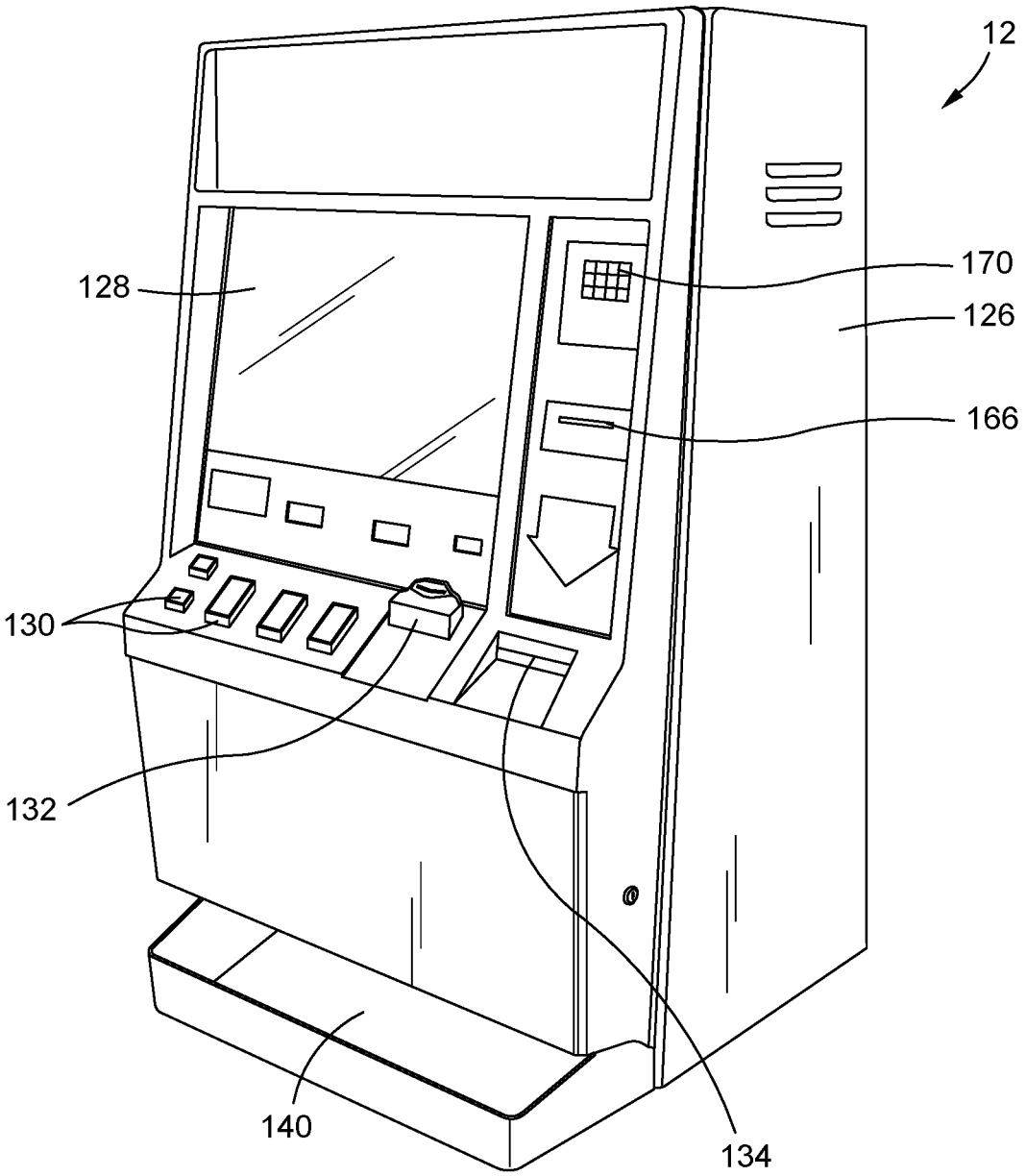
FIG. 2 illustrates one embodiment of a gaming machine.

One configuration of the gaming machine 12 is illustrated in FIG. 2. As illustrated, the gaming machine 12 generally comprises a housing or cabinet 126 for supporting and/or enclosing various components required for operation of the gaming machine. In the embodiment illustrated, the housing 126 includes a door located at a front thereof, the door capable of being moved between an open position which allows access to the interior, and a closed position in which access to the interior is generally prevented. The configuration of the gaming machine 122 may vary. In the embodiment illustrated, the gaming machine 122 has an "upright"

configuration. However, the gaming machine 122 could have other configurations, shapes or dimensions (such as being of a "slant"-type, "bar-top" or other configuration as is well known to those of skill in the art).

The gaming machine 122 preferably includes at least one display device 128 configured to display game information. The display device 128 may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touch-screen, a light emitting display (LED) or other suitable displays now known or later developed, in a variety of resolutions, sizes and formats (e.g. 4:3, widescreen or the like). The display 128 may be capable of projecting or displaying a wide variety of information, including images, symbols and other indicia or information associated with game play, game promotion or other events. The gaming machine 12 might include more than one display device 128, such as two or more displays which are associated with the housing 126. The gaming machine 12 might also include a top box or other portion. Such a top box might include one or more display devices 128, such as in addition to one or more main displays which are associated with the housing 126. Also, the gaming machine 12 might include side displays (such as mounted to the exterior of the housing 126) and might include multiple displays of differing sizes.

While the display devices may comprise one or more video displays, (such as for presenting video poker, video slots or other video-based games) in another embodiment, the gaming machine 1 may include one or more physical reels capable of displaying game information, such as slot symbols. In such a configuration, means are provided for rotating the physical reels. In one or more embodiments, the means may comprise a mechanical linkage associated with a spin arm, with movement of the spin arm (a "pull") by a player causing the reels to spin. In such an arrangement, the reels are generally allowed to free-wheel and then stop. In another embodiment, electronically controlled mechanisms are arranged to rotate and stop each reel. Such mechanisms are well known to those of skill in the art. In this arrangement, actuation of the spin arm or depression a spin button causes a controller (not shown) to signal the activation of the spin mechanism associated with one or more of the reels. Preferably, the controller is arranged to either turn off the signal to the device(s) effecting the rotation of each or all of the reels or generates a signal for activating a braking device, whereby the reels are stopped. The principal of such an arrangement is described in U.S. Pat. No. 4,448,419 to Telnaes, which is incorporated herein by reference.

As described in more detail below, the gaming machine 12 is preferably configured to present one or more games upon a player making a monetary payment or wager. In this regard, as described in more detail below, the gaming machine 12 includes a mechanism or means for accepting monetary value.

In one embodiment, certain game outcomes (but preferably not all game outcomes) may be designated as winning outcomes (the non-winning outcomes may be referred to as losing outcomes). Prizes or awards may be provided for winning outcomes, such as monetary payments (or representations thereof, such as prize of credits), or promotional awards as detailed herein. As detailed below, the gaming machine 12 preferably includes a mechanism or means for returning unused monetary funds and/or dispensing winnings to a player.

The gaming machine 12 preferably includes one or more player input devices 130 (such as input buttons, plunger mechanisms, a touch-screen display, joystick, touch-pad or the like). These one or more devices 130 may be utilized by the player to facilitate game play, such as by providing input or instruction to the gaming machine 122. For example, such input devices 130 may be utilized by a player to place a wager, cause the gaming machine 122 to initiate a game, to spin reels, indicate cards to be held or discarded, to "cash out" of the gaming machine, or to provide various other inputs, such as depending upon the particular game being presented.

In one preferred embodiment, and as better illustrated in FIG. 1, the gaming machine 122 includes at least one microprocessor or controller 150 for controlling the gaming machine, including receiving player input and sending output signals for controlling the various components or peripheral devices of the machine 122 (such as generating game information for display by the display 128). The controller 150 may be arranged to receive information regarding funds provided by a player to the gaming machine, receive input such as a purchase/bet signal when a purchase/bet button is depressed, and receive other inputs from a player. The controller 150 may be arranged to generate information regarding a game, such as generating game information for display by the at least one display 128, for determining winning or losing game outcomes and for displaying information regarding awards for winning game outcomes, among other things.

The controller 150 may be configured to execute machine readable code or "software" or otherwise process information, such as obtained from a remote server. Software or other instructions may be stored at a memory or data storage device, e.g. in a fixed or non-transitory configuration. The memory may also store other information or data, such as data stored in table or other forms (including, but not limited to look-up tables, pay tables and other information, including tracked game play information). The gaming machine 12 may also include one or more random number generators for generating random numbers (such as implemented by a random number generator software module stored in the memory and executable by the processor or controller), such as for use in selecting slot symbols, cards or other game symbols, etc. (depending upon the game being presented) and for presenting the game in a random fashion (e.g. whereby the game is presented in a manner in which the player cannot control the outcome) or pseudo-random fashion (e.g. such as where the game includes a skill component which can affect the outcome of the game).

Preferably, the controller is configured to execute machine readable code or instructions (e.g. software) which are configured to implement the game. In this regard, the gaming machine is specially configured to present the game of the invention via specific software and/or hardware which causes the gaming machine to operate uniquely. For example, the controller of the gaming machine 12 may be configured to detect a wager, such as a signal from a player's depressing of the "bet one" button (such as one of the buttons 130). Upon such an event and/or the player otherwise signaling the gaming machine to present the game, the controller may be configured to cause the at least one display 128 to display unique information, such as a unique graphical interface or unique game display, including game symbols or other game information (such as graphically represented images of cards, slot symbols, dice, etc.). The controller 150 may accept input from a player of game inputs, such as a request to spin reels or the like, via the one or more player input devices of the gaming machine 12. As indicated above, the machine readable code may be configured in various manners, such as by having various "modules" of software which are designed to implement specific features of the game play or game presentation.

The gaming machine 12 may be configured to generate and present games in a stand-alone manner or it may be in communication with one or more external devices at one or more times. For example, the gaming machine 12 may be configured as a server based device and obtain game code or game outcome information from a remote game server (in which event the gaming machine controller may receive game information from the server, such as game outcome information, and use that server-generated information to present the game at the gaming machine). For example, the gaming machine 12 might be configured as a stand-alone device or as a server-based device for presenting games as Class III games (as defined by the U.S. Indian Gaming Regulatory Act) or as a server-based device for presenting games as Class II games (as defined by the U.S. Indian Gaming Regulatory Act).

As indicated, the gaming machine 12 is configured to present one or more wagering games. The gaming machines 12 is preferably configured to accept value, such as in the form of coins, tokens, paper currency or other elements or devices representing value such as monetary funds. Thus, as indicated above, the gaming machine 12 preferably includes a mechanism or means for accepting monetary value. For example, as illustrated in FIG. 2, the gaming machine 12 might include a coin acceptor 132 for accepting coins. Of course, associated coin reading/verifying devices and coin storage devices may be associated with the gaming machine 12 if it is configured to accept coins. Likewise, the gaming machine 12 might include a media reader or validator 134. Such a reader may be configured to accept and read/verify paper currency and/or other media such as tickets. Of course, in such event the gaming machine 12 may further be configured with one or more paper currency or ticket storage devices, such as cash boxes, and other paper currency or media handling devices (including transport devices).

The gaming machine 122 might also be configured to read FOBs, magnetic stripe cards or other media having data associated therewith and via which value or funds may be associated with the gaming machine 122. The mechanism for accepting monetary value might also comprise hardware and/or software which allows a player to transfer (such as electronically) funds from an account, such as a casino wagering account, or a bank or other financial institution account. Such a mechanism might include a communication interface which permits the gaming machine to communicate with a mobile phone, PDA, tablet or other electronic device of the player (such as via a physical interface or wired or wireless communications links, such as to enable the transfer of funds from the player to the gaming machine or system).

When the player associates funds with the gaming machine or an associated system, a credit balance is generated. The credit balance may comprise a plurality of monetary value credits. The player may wager some or all of the associated monetary value, such as by wagering one or more of the credits associated with the credit balance. For example, the player might provide input to a wager button or touch screen interface to wager a certain number of credits (such as "Bet 1 Credit", "Bet 5 Credits", "Bet Maximum Credits" or other options). In one embodiment, when the player's wager is received, the player's credit balance is reduced by the number of wagered credits. The player might then provide a separate input to begin the game. In other embodiment, the player might select a "play game" input, such as by pressing a "spin" button, which input is taken to comprise both an instruction to place a wager (such as of a pre-set or pre-selected number of credits) and to start the game. Of course, other configurations may be implemented for accepting monetary value from the player and for allowing the player to place a wager from the associated monetary value. The credit balance and amounts wagered, won and the like may be tracked by one or more credit meters. In one embodiment, as illustrated in FIG. 1, the credit balance and/or other aspects of monetary transactions, may be tracked by one or more meters 152. For example, one meter 152 might track a current credit balance, another meter might track a total of all monetary value associated with the gaming machine 12, another meter might track credits which are cashed-out of the gaming machine, etc. In one embodiment, the meters 152 might comprise one or more Advanced Funds Transfer (AFT) meters, which meters track funds transfers to and from a gaming machine from a system (as opposed to standard meters used to track monetary funds provided to the gaming machine directly, such as via input of monetary bills to a bill acceptor of the gaming machine 12).

In one embodiment, the gaming machine 12 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. These winnings may be associated with the player's credit balance, thus increasing the player's credit balance.

In one embodiment, the player may provide an input to the gaming machine 12 to indicate their desire to cash out, such as by selecting a "cash out" button (such as implemented via one of the buttons 132) or touch screen feature or providing other input. In response, a monetary value represented by the player's credit balance or the like is preferably paid, transferred or otherwise provided to the player. For example, upon an award or at cash-out, associated funds may be paid to the player by the gaming machine 12 dispensing coins to a coin tray 140. In another embodiment, funds may be issued by dispensing paper currency or other media. In yet another embodiment, a player may be issued a media, such as a printed ticket, which ticket represents the value which was paid or cashed out of the machine. The ticket or other media may be printed, generated or written to by a printer or media writer 154, as illustrated in FIG. 1. The aspects of gaming machine "ticketing" systems are well known. One such system is described in U.S. Pat. No. 6,048,269 to Burns, which is incorporated herein in its entirety by reference. In yet another embodiment, the cash-out might result in the dispensing of a card or other media which stores or represents the cashed-out funds, such as by writing funds information to a magnetic stripe of a card which is inserted into a media writer of the gaming machine or dispensed from the machine. In other embodiments, the cash-out mechanism may result in the funds value being transferred to an external device or account, such as a player's casino account (such as associated with a casino server), a remote bank or other financial account, or an electronic device such as a player's phone, PDA or tablet.

The gaming machine 12 may also include a player tracking device, such as a card reader 166 and associated keypad 170. Such player tracking devices are well known and may permit the game operator to track play of players of the gaming machine. The tracked play may be utilized to offer player bonuses or awards.

As illustrated in FIG. 1, the gaming machine controller 150 may communicate with the various components or "peripherals" of the gaming machine 12, such as by a bus or I/O interface 156.

A casino may have numerous of such gaming machines 12, such as located on a casino floor or in other locations. Of course, such gaming machines 12 might be used in other environments, such as an airport, a bar or tavern or other locations.

Preferably, the gaming machine 12 includes one or more communication interfaces for communicating with one or more external devices or systems. For example, the gaming machine 12 may have a main gaming machine communication interface via which the master gaming controller 150 or other elements of the gaming machine may communicate with such external devices or systems. In one embodiment, such an interface may comprise a slot accounting system or "SAS" port 158. The gaming machine 12 might have one or more of such ports and/or other ports or interfaces (wherein the communication port or interface, including the physical configuration of the port and the communication protocol utilized, may vary).

It will be appreciated that the gaming machine 12 illustrated in FIGS. 1 and 2 is only exemplary of one embodiment of a gaming machine. For example, it is possible to for the gaming machine to have various other configurations, including different shapes and styles and having different components than as just described.

As illustrated in FIG. 1, the cashless interface 14 is preferably communicatively associated with the gaming machine 12. As described below, the cashless interface 14 is used to facilitate the transfer of monetary funds, such as in credit format, to and from the gaming machine 12. The cashless interface 14 might be physically located outside of the housing of the gaming machine 12 or might be located in the housing thereof. In one embodiment, an existing gaming machine 12 may be retrofit with the cashless interface 14 in order to implement the cashless functionality described herein (such as when, as manufactured, the gaming machine 12 did not otherwise have or support that functionality). In other embodiments, the gaming machine 12 might be manufactured to include the cashless interface 14.

Referring to FIG. 1, the cashless interface 14 may comprise a processor 200, a I/O interface or bus 202, a memory 204, such as for storing machine-readable code which is executable by the processor 200, and at least one communication interface 206. In one embodiment, the communication interface 206 is configured to facilitate one or more wired and/or wireless communication links. As one non-limiting example, the communication interface 206 may comprise a first port, such as a serial port, for facilitating a wired communication link between the SAS port 158 of the gaming machine 12 and the cashless interface 14. The communication interface 206 may include a second port, such as a second serial port, for facilitating a wired communication link between the cashless interface 14 and the SMIB 16. The communication interface 206 may further include one or more additional ports, such as an Ethernet port for facilitating a wired communication link between the cashless interface 14 and the cashless controller 22.

The communication interface 206 may also comprise a wireless communication interface. Such a wireless communication interface may facilitate a wireless near field communications (NFC), Bluetooth low energy ("BLE) or other types of wireless communications, such as with a player's mobile communication device 30. The various components of the cashless interface 14 may be located inside of or otherwise be associated with a housing (not shown). Further, the cashless interface 14 may include or be connected to one or more power supplies.

In one embodiment, the cashless interface 14 is that, namely just an interface to a particular gaming machine 12. In one embodiment, the cashless controller 22 is configured to communicate with the cashless interfaces 14 of a plurality of gaming machines 12. Relative to a large casino, there may be as few as one or more than one cashless controller 22. For example, a single cashless controller 22 might be configured to communicate with the cashless interfaces of between 1 and 50 gaming machines, such that a casino floor having thousands of gaming machines might have multiple cashless controllers.

Each cashless controller 22 may include a processor, a memory, machine readable code stored in the memory and executable by the processor, and one or more communication interfaces. In one embodiment, as described, the cashless controller 22 may communicate with a plurality of cashless interfaces 14. In one embodiment, each cashless interface 14 may have an IP address and the cashless controller 22 may communicate with each cashless interface 14 via a TCP/IP protocol.

The cashless controller 22 is preferably communicatively coupled to the financial system 26, such as via a gateway 24. The gateway 24 may itself comprise a computing device (such as with a processor, memory and machine-readable code and a communication interface) which facilitates the communications between the cashless controller 22 and the financial system 26, such as over a secured communication link.

In one embodiment, the cashless controller 22 is configured to direct or route instructions (or data/signals, etc.) to each specific cashless interface 14 (and thus associated gaming machine 12), such as in response to instructions or information from the financial system 26.

As illustrated in FIG. 1, the financial system 26 may comprise at least one financial server 20. In one embodiment, the financial system 26 may have multiple components, such as a financial processing server, a transaction and information database, a wallet server, and one or more workstations. The financial server 20 may comprise, for example, a computing device having a processor, a memory, machine-readable code or "software" stored in the memory and executable by the processor, and at least one communication interface which permits the server to communicate with other devices and/or systems.

In one embodiment, the gateway 24 may be located at a casino and include firewall or similar security features, while the financial system 26, such as the server 20 and database 26, may be located remotely, such as at a facility of a financial processor (such as Everi Payments Inc. of Las Vegas, Nev.).

In one embodiment, the financial system 26 is configured to implement wallet functionality. Thus, the financial system 26 includes a plurality of e-wallets 28. The e-wallets 28 comprise virtual wallets—e.g. accounts or files which are tied to one or more individuals and have funds associated therewith. The funds may be stored in various locations, such as by being associated with an account at a bank or other financial institution.

Preferably, the financial system 26 is configured to communicate with one or more external banks or other financial entities B, such as via a banking or financial network 34. Communications between the financial system 26 and the bank(s) B may be facilitated through a communication gateway or the like.

Additional details of the configuration of the financial system 26 will be appreciated from details of the functionality of the invention which is described in more detail below.

The cashless interface 14 may communicate with one or more other devices or systems, such as the casino slot management system 18. Such systems are well known, and may comprise one or more servers, workstations and the like. The SMS system 18 may implement casino accounting functionality, such as by tracking monetary funds which are associated with each gaming machine, wagers made at each gaming machine, winnings paid by each gaming machine, and cash-outs of monetary value funds from each gaming machine.

In one embodiment, normal communications between the gaming machine 12 and the slot management system 18 via the SMIB 16 are permitted through the cashless interface 14. In particular, normal event reporting via the gaming machine 12 to the slot management system 18 is output via the SAS port 158, is directed by the cashless interface 14 to the SMIB 16 and on to the slot management system 18. Likewise, communications from the slot management system 18 to the gaming machine 12 are routed from the SMIB 16 to the SAS port 158 via the cashless interface 14. In this manner, the cashless interface 14 does not interfere with normal communications between the gaming machine 12 and the slot management system 18.

In one embodiment, the cashless interface 14 may act as a passthrough for such communications, whether in an active mode (e.g. when activated and being used to process funds transfers to and from the gaming machine 12 as described herein), or in a passive mode (such as if the cashless interface 14 malfunctions or loses power); wherein in such an event, processing of the transfers herein may be prevented, but normal communication between the gaming machine 12 and the SMS 18, via the SMIB 16, continue without disruption. In one embodiment, during normal operation, the cashless interface 14 buffers all incoming transactions or data received from the SMIB 16, allowing the cashless interface 14 to process transaction with the gaming machine 12 without interruption or fault. Once such direct transactions are completed, the buffered messages are passed from the cashless interface 14 to the gaming machine 12 in the order received from the SMIB 16. On the other hand, during passive mode, the cashless interface 14 does not buffer incoming transactions from the SMIB 16.

In one embodiment, an aspect of the system comprises a player interface or application for a player device. As illustrated in FIG. 1, the player device 30 may comprise, for example, a tablet, phone, PDA or other communication device. In a preferred embodiment, the player device 30 is a mobile device. The player device 30 may have a processor and a memory and be configured to execute one or more applications (including dedicated applications, browsers and the like).

In one embodiment, the application is an e-wallet application. When executed, the e-wallet application running on the player device 30 causes the player device 30 to display one or more graphical player interfaces or other information, such as via a display thereof. Further, the application may implement (alone or in combination with other devices/systems, such as the financial system 26), various functionality. In one embodiment, the application facilitates the association of funds with a player's e-wallet, such as from an external financial account (bank credit, debit or savings account, etc.). Further, the application facilitates the transfer of funds from the player's e-wallet to a gaming machine or the transfer of funds from a gaming machine to the player's e-wallet.

Aspects of the invention comprise methods for associating monetary value funds with a gaming machine and for moving funds from a gaming machine, and preferably electronically represented funds, such as to and from a e-wallet.

Figure 3:
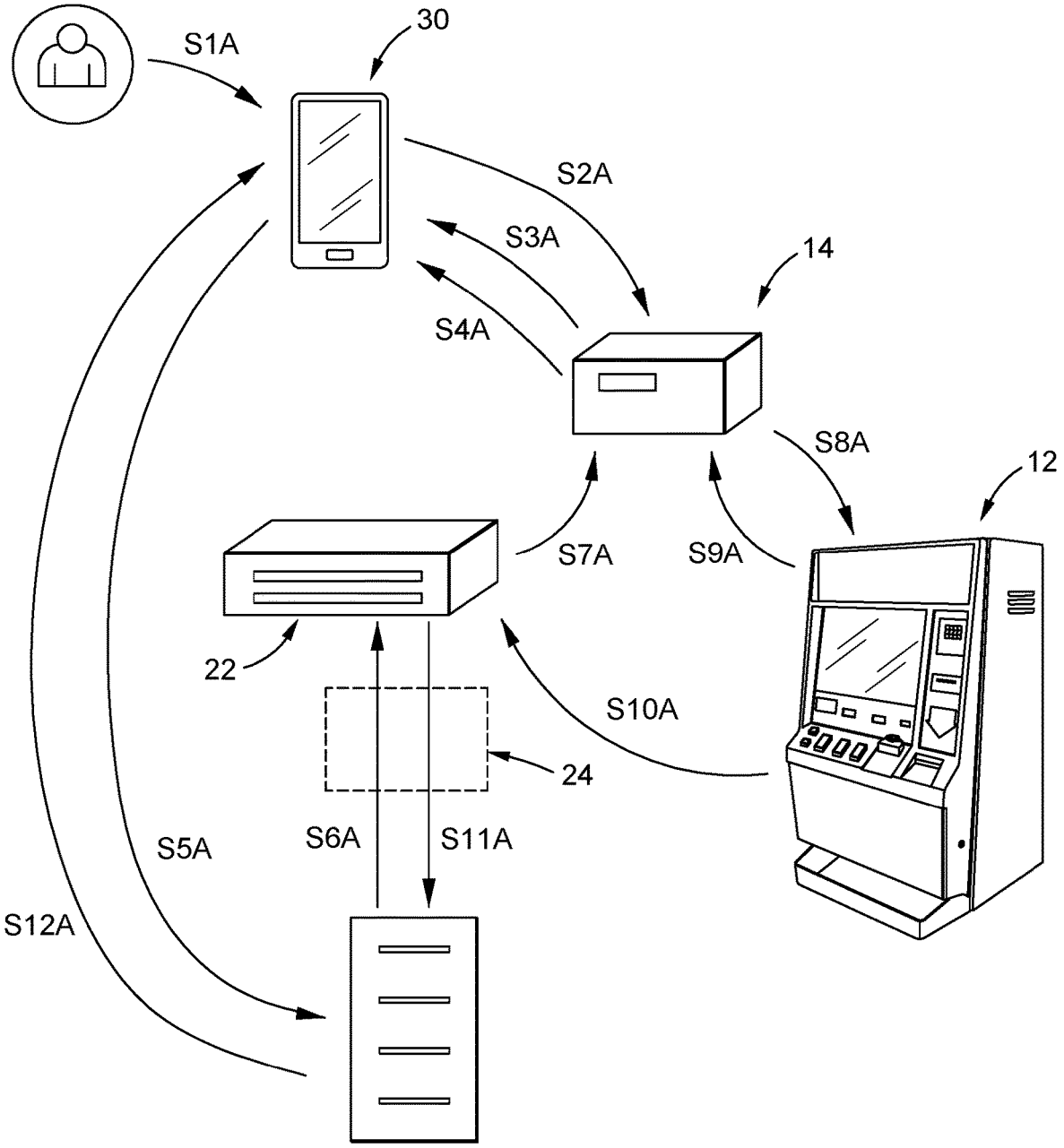
FIG. 3 is a flow diagram of a method of moving funds from a funds source to a gaming machine.

FIG. 3 is a flow diagram of a method of moving funds electronically to a gaming machine, and preferably from an e-wallet to a gaming machine, such as via the system 10 described above.

In a step S1, a player may use the application on their player device 30 to designate an amount of monetary funds to be transferred from their e-wallet to a gaming machine 12. This request may be made by input to the player interface presented by the application at the player device 30. Of course, the player must first have an e-wallet and have funds associated with the e-wallet. E-wallets and methods for the association of funds therewith are known and may depend upon the particular provider. For example, the player might set up their e-wallet by first downloading the application to their player device 30, running it and creating a player profile and associated e-wallet, and then associating player financial information (such as with a credit card number, bank account information, etc.) with the e-wallet. The player might then use that financial information to effectuate a transfer of funds to the e-wallet, such as from a bank account, credit account or the like which is associated with the financial information.

In a step S2, the player provides input to initiate the transfer of funds. Preferably, the player initiates the transaction in close proximity to a particular gaming machine 12 with which the player wishes to associate the funds. In one embodiment, the input to initiate the transfer may be a "tap" input. This input may cause the gaming machine 12 (and particularly the cashless interface 14) to implement a pairing or linking of the gaming machine 12, and particularly the cashless interface 14) to the player's device 30. In one embodiment, this pairing or linking occurs using near field communications ("NFC").

In a preferred embodiment, in a step S4, the cashless interface 14 generates an NFC signal which is detected by the player device 30 and which includes or contains information which identifies the particular gaming machine 12 which the player has identified (such as by tapping) to which the funds are to be transferred. This information may comprise, for example, a unique machine ID.

In a step S5, the player device 30 generates and transmits a request to the financial system 26 of the desired transaction amount and the designated gaming machine. This request may be transmitted via a wireless signal from the player device 30 to the financial system 26. Of course, this request includes information which designates the player and/or the player's e-wallet.

In a step S6, the financial system 26 generates and transmits a request or instructions to the cashless controller 22 (such as via the gateway 24). This request is preferably dependent upon a confirmation by the financial system 26 that the amount of funds that the player has requested to be transferred from their e-wallet are associated with their wallet, and may comprise instructions for the cashless controller 22 to cause the cashless interface 14 of the designated machine load the desired funds onto its associated gaming machine 12.

In a step S7, the cashless controller 22 transmits a signal to the cashless interface 14 of the designated gaming machine 12 (such as by using information in the request from the financial system 26, such as the machine ID of the gaming machine to which the funds are to be directed, where the machine ID may be tied to an IP address for the machine, which IP address is used to route instructions via TCP/IP to the cashless interface 14 of the designated gaming machine 12). In an embodiment where the gaming machine 12 communicates using the SAS protocol (IGT, Reno Nev.), this request may comprise an "AFT IN" instruction which is transmitted to the cashless interface 14.

Next, the cashless interface 14 communicates with the gaming machine 12 in order to load the requested/transferred funds. When the gaming machine 12 communicates via the SAS protocol, this may comprise the cashless interface 14 transmitting a signal to the gaming machine 12 to lock up the AFT meters (such as via SAS command LP 74). In a step S9, the gaming machine 12 may then respond to the cashless interface 14 to effectuate a transfer of the monetary value funds to the gaming machine 12. Preferably, these funds are associated with one or more of the meters of the gaming machine 12, such as the AFT meters.

In a step S10, the transfer is preferably confirmed by the gaming machine 12. In particular, the controller of the gaming machine may send a confirmation through the cashless interface 14 to the cashless controller 22. The cashless controller 22 may then send, as at step S11, a confirmation or request to the financial server 26 to update the player's e-wallet balance to reflect that the funds have successfully been transferred out of the e-wallet account (and to the gaming machine), thus resulting in a reduction in the balance of the use's e-wallet account.

The gaming machine 12 may then reflect a corresponding increase in the number of credits available to be wagered at the gaming machine 12, such as in the form of a credit balance. The player may then wager one or more of those credits, cash them out (such as by receiving a ticket representing the monetary value of the credits) or, as described below, by transferring the monetary value of those credits back to the player's e-wallet.

As noted above, normal operation of the gaming machine 12 is not changed, wherein when the funds are associated with the gaming machine 12 and the gaming machine's meters, the association of those funds with the gaming machine may be reported in the form of an updated meter balance by the gaming machine to the casino's SMS system 18, such as by a signal that is output through the SAS port 158 and through the cashless interface 14 and SMIB 16 thereto.

Figure 4:
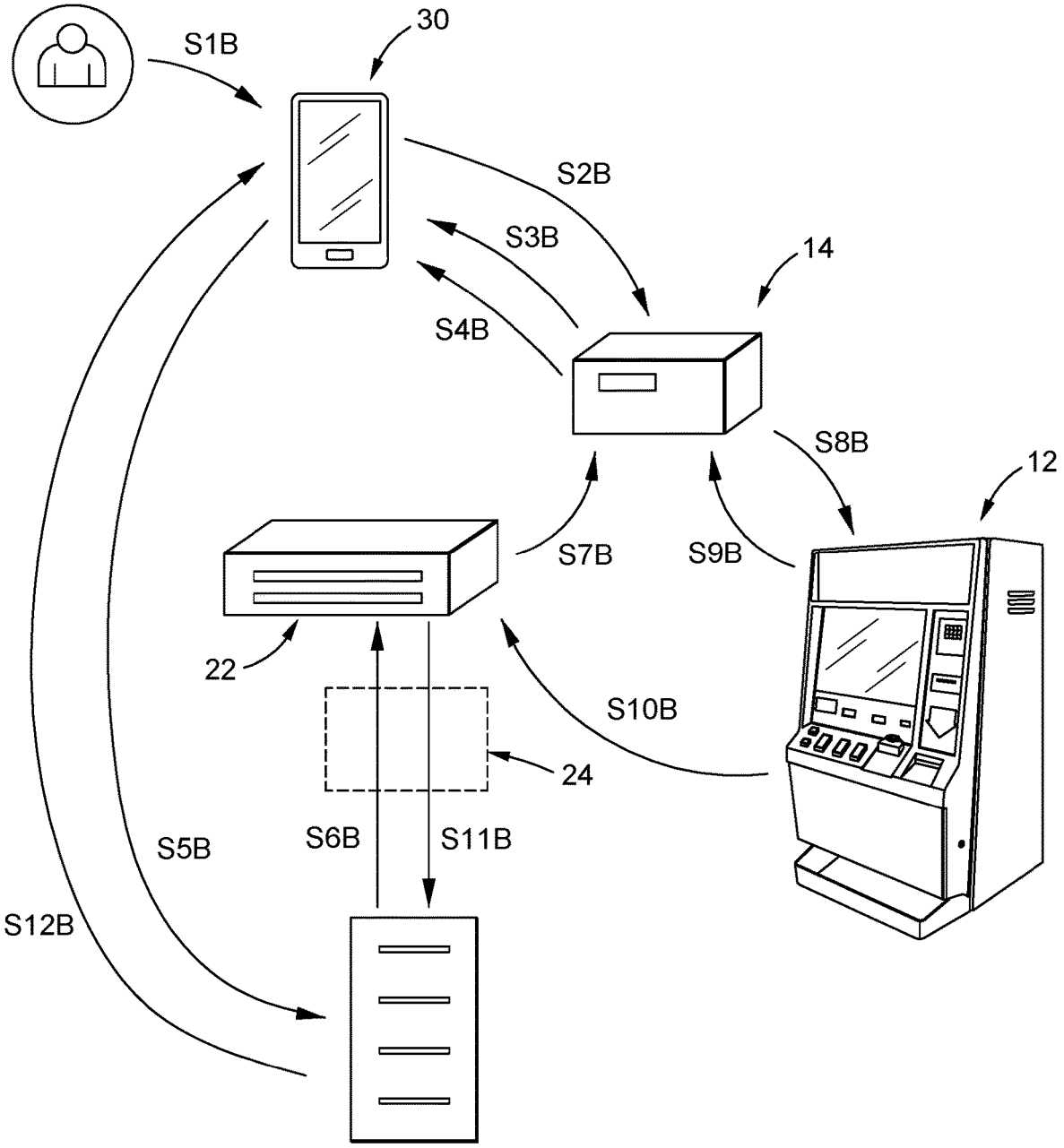
FIG. 4 is a flow diagram of a method of moving funds from a gaming machine to a funds source.

FIG. 4 is a flow diagram of a method of moving funds electronically from a gaming machine to another location, and preferably an e-wallet, such as via the system described above. This method is similar in many respects to the method of moving funds to the gaming machine. Thus, in a step S1, a player may use the application on their player device 30 to designate an amount of monetary funds to be transferred from the gaming machine. This request may be made by input to the player interface presented by the application at the player device 30. Again, where the funds are to be moved or transferred from the gaming machine to a player's e-wallet, the player must have an existing e-wallet (or must first create one).

In a step S2, the player provides input to initiate the transfer of funds. Preferably, the player initiates the transaction in close proximity to a particular gaming machine 12 with which the player wishes to associate the funds. In one embodiment, the input to initiate the transfer may be a "tap" input. This input may cause the gaming machine 12 (and particularly the cashless interface 14) to implement a pairing or linking of the gaming machine 12, and particularly the cashless interface 14) to the player's device 30. In one embodiment, this pairing or linking occurs using near field communications ("NFC").

In a preferred embodiment, in a step S4, the cashless interface 14 generates an NFC signal which is detected by the player device 30 and which includes or contains information which identifies the particular gaming machine 12 which the player has identified (such as by tapping) to which the funds are to be transferred. This information may comprise, for example, a unique machine ID.

In a step S5, the player device 30 generates and transmits a request to the financial system 26 of the desired transaction amount and the designated gaming machine. This request may be transmitted via a wireless signal from the player device 30 to the financial system 26. Of course, this request includes information which designates the player and/or the player's e-wallet.

In a step S6, the financial system 26 generates and transmits a request or instructions to the cashless controller 22 (such as via the gateway 24). This request may comprise instructions for the cashless controller 22 to cause the cashless interface 14 of the designated machine load the desired funds onto its associated gaming machine 12.

In a step S7, the cashless controller 22 transmits a signal to the cashless interface 14 of the designated gaming machine 12 (such as by using information in the request from the financial system 26, such as the machine ID of the gaming machine to which the funds are to be directed). In an embodiment where the gaming machine 12 communicates using the SAS protocol (IGT, Reno Nev.), this request may comprise an "AFT OUT" instruction which is transmitted to the cashless interface 14.

Next, the cashless interface 14 communicates with the gaming machine 12 in order to load the requested/transferred funds. When the gaming machine 12 communicates via the SAS protocol, this may comprise the cashless interface 14 transmitting a signal to the gaming machine 12 to lock up the AFT meters (such as via SAS command LP 74). In a step S9, the gaming machine 12 may then respond to the cashless interface 14 to effectuate a transfer of the monetary value funds from the gaming machine 12.

In a step S10, the transfer is preferably confirmed by the gaming machine 12. In particular, the controller of the gaming machine may send a confirmation through the cashless interface 14 to the cashless controller 22. The cashless controller 22 may then send, as at step S11, a confirmation or request to the financial server 26 to update the player's e-wallet balance to reflect that the funds have successfully been transferred from the gaming machine 12 to the player's e-wallet account, thus resulting in an increase in the balance of the use's e-wallet account.

The gaming machine 12 may then reflect a corresponding decrease in the number of credits available to be wagered at the gaming machine 12, such as in the form of a reduced credit balance.

It will thus be appreciated that the system 10 of the invention, including the cashless interface 14 provides the capability to download and upload funds in/out of a gaming machine, such as by updating one or more of the meters of the gaming machine 12. In one embodiment, a player can use their phone or other mobile device to send instructions to a financial system to transfer funds from their e-wallet to a gaming machine, wherein based upon a syncing or linking of the player's device with the cashless interface, the financial system may send or cause the cashless controller 22 or interface 14 to indicate to the controller of the gaming machine to increment or decrement one or more credit meters thereof so as to increase or decrease the credit balance at the gaming machine.

Additional aspects of the invention will now be described.

In one embodiment, the system and method may permit the transfer of various types of credits to and from the gaming machine. For example, the credits might be cashable, restricted and/or non-restricted credits to and from the gaming machine. As one example, a casino might reward a player with restricted gaming credits. These credits might be associated with a particular account in the player's wallet. The player might transfer the restricted credits to the gaming machine, which credits are then which are associated with the gaming machine as restricted or "non-cashable" credits, such as where those credits cannot be cashed-out of the gaming machine directly.

In one embodiment, "pairing" of a player's device 30 with the gaming machine 12 may be effectuated in various manners. In one embodiment, the pairing is via NFC and a transmission of machine identifying information to the player's device 30 (which then provides that information to the financial system 26 for use in directing the desired funds request to back to the appropriate machine). Of course, other methods of pairing might be utilized, including direct connection and the like.

For security purposes, in one embodiment, the NFC (or other machine ID) tags are periodically changed, such as every 30 seconds, such as under the control of the financial system 26. As indicated, each tag denotes a particular associated gaming machine 12. For security purposes, the tags may be changed frequently so that the tag associated with each machine is effectively unique at any given time.

In one embodiment, the system and method may include a means for monitoring whether the player remains at the gaming machine 12. For example, in one embodiment, a player's device 30 may communicate with a designated gaming machine 12 (such as the cashless interface 14 thereof), such as via a BLE link. So long as this link remains active, the cashless interface 14 knows that the player remains in the vicinity of the gaming machine 12. If the BLE link is lost, such as because the player has left the gaming machine 12, then the gaming session may be ended. In one embodiment, if the player left funds on the gaming machine 12, then the cashless interface 14 might be configured (either directly, via the cashless controller 22 or financial system 26) to cause those funds to be transferred from the gaming machine 12 to the player's wallet, effectively removing the funds from the gaming machine 12 so that they can't be used by another player. This process would be similar to that illustrated in FIG. 4, except that the transfer of funds from the gaming machine 12 is not player initiated, but is instead automatic.

It will be appreciated that the method and system may have other features and configurations. For example, in the embodiment described, the gaming machine may be configured to communicate (via its SAS port) using a SAS protocol. Such a protocol is implemented over a serial communications port. The method of the invention could be implemented relative to a gaming machine that uses other communication protocols, such as G2S (IGT, Reno Nev.). In such event, the software of the cashless controller 22 and the cashless interface 14 may be configured to facilitate such a protocol, such as by generating G2S commands. Further, communications may be via other types of communication ports and paths between the cashless interface 14 and the gaming machine 12, such as Ethernet.

In one embodiment, the system of the invention utilize one or more cashless controllers 22 and one or more gateways 24. In one embodiment, the functions of these elements might be combined. Further, it is possible, though less desirable due to cost, to integrate the functionality of the cashless controller 22 into each cashless interface 14.

In one embodiment, the cashless interface 14 might communicate with (such as via the cashless controller 22 and gateway 24) various different financial systems 26, such as systems of different providers, such as via different APIs.

Various configurations of requests/instructions may be utilized to implement the functionality described herein. For example, as described, in a method of loading funds to a gaming machine, the financial system 26 transmits instructions which cause the cashless interface 14 to implement the load funds request. In one embodiment, these instructions may comprise an instruction (sent through the gateway 24) to the cashless controller 22 to implement a load funds action. Upon receiving that instruction, the cashless controller 22 may generate and transmit particular instructions to the cashless interface 14, such as an "AFT OUT" call. This call may be received by the cashless interface 14, which then generates and transmits a "LP 74" instruction to the gaming machine 12. In other embodiments, however, the requests or instructions might be generated and transmitted in other manners, such as by having the financial system 26 generate instructions which are received by the cashless controller 22 and routed to the cashless interface 14, etc.

In one embodiment, the system 10 of the invention might communicate with or be integrated with other systems and devices. Particularly because the cashless interface 14 communicates with the gaming machine 12, and more particularly receives the output of the gaming machine via its communication port (such as SAS port), a wide variety of additional functionality can be implemented.

For example, the financial system 26 might include, or the financial server 20 might be linked to, an anti-money laundering ("AML") system. This system might monitor transactions, such as transfers of funds to and from the gaming machines, for the purpose of detecting money laundering. The AML system might be configured to monitor just wallet transactions effectuated by the cashless interface 14, but might be configured to monitor all monetary transactions as reported by the gaming machine 12 via its communication (such as SAS) port.

In addition, the system 10 of the invention may be linked to a casino's player tracking system or report information to such a system. Again, this information may relate specifically to wallet funds transfers as described above, or other activities, such as amounts cashed out, monies directly provided to the gaming machine 12, etc., such as reported via the gaming machine's communication (such as SAS) port. In one embodiment, the use of the player's device 30 and the cashless interface 14 may eliminate the need for a player to utilize a player's card and a player card reader of the gaming machine 12, in that the player can be identified via their device 30 and the application that they are using.

In one embodiment, the system 10, such as the cashless interface 14, may be linked to a jackpot processing system, such as Everi Payment Inc.'s (Las Vegas, Nev.) Jackpot Xpress (JX) and Forms Xpress (FX) products. For example, the cashless interface 14 may be configured to notify such a system when the gaming machine 12 reports a jackpot win. Those systems may then be configured to implement various jackpot related functionality, such as the processing of jackpot-related forms (including required tax forms), processing the jackpot funds (such as by putting the credits back on to gaming machine 12 for play (such as by a KeyToCredit function), by transferring the funds to the player's wallet, etc.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A system for moving funds between an e-wallet and a gaming machine, comprising:

a cashless interface, said cashless interface comprising a controller, a memory, machine-readable code stored in said memory and executable by said controller, and a communication interface, said cashless interface interposed between a communication port of said gaming machine and a slot machine interface board;

a cashless controller, said cashless controller in communication with said cashless interface;

a gateway configured to facilitate communication between said cashless controller and a financial system;

said financial system comprising a database of e-wallet accounts and a financial server, said financial server in communication with said gateway, said financial server comprising a processor, a memory, and machine-readable code stored in said memory and configured to cause said processor to:

receive from a player's communication device of a request to move funds to or from an e-wallet of said player and a gaming machine, said request including information identifying said gaming machine;

process said request;

transmit a request to said cashless interface, through said gateway and said cashless controller, to transfer funds to or from said gaming machine and said e-wallet of said player; and adjust a balance of funds associated with said e-wallet of said player based upon an amount of funds transferred.

2. The system in accordance with claim 1, wherein said communication port of said gaming machine comprises a slot accounting system (SAS) port.

3. The system in accordance with claim 1 wherein said cashless controller is in communication with cashless interfaces associated with a plurality of different gaming machines.

4. The system in accordance with claim 1 wherein said cashless interface comprises a first serial port connected to said communication port of said gaming machine, a second serial port connected to said slot machine interface board, and third port connected to said cashless controller.

5. The system in accordance with claim 4 further comprising a wireless communication interface.

6. The system in accordance with claim 5 wherein said wireless communication interface supports NFC communications.

7. The system in accordance with claim 1 wherein said information identifying said gaming machine comprises a gaming machine ID provided by NFC by said cashless interface to said player's communication device.

8. The system in accordance with claim 1 wherein said request to move funds comprises a request to load funds to one or more AFT credit meters of said gaming machine.

9. The system in accordance with claim 1 wherein said request to move funds comprises a request to unload funds from one or more AFT credit meters of said gaming machine.

* * * * *